United States Patent [19]

Vavra et al.

[11] Patent Number: 4,584,943

[45] Date of Patent: Apr. 29, 1986

[54] MISSILE HEAD TO BE RELEASED IN AN AIRPLANE CARGO DROP OR FROM A FLYING BODY

[75] Inventors: Norbert Vavra, Willich; Jens Seidensticker, Kaarst, both of Fed. Rep. of Germany

[73] Assignee: Rheinmetall GmbH, Duesseldorf, Fed. Rep. of Germany

[21] Appl. No.: 628,751

[22] Filed: Jul. 9, 1984

[30] Foreign Application Priority Data

Jul. 7, 1983 [DE] Fed. Rep. of Germany ..... 3324435

[51] Int. Cl.[4] ..... F42C 13/04

[52] U.S. Cl. ..... 102/214

[58] Field of Search ..... 102/214, 213, 211, 387, 102/393

[56] References Cited

U.S. PATENT DOCUMENTS

| | | | |
|---|---|---|---|
| 3,818,833 | 6/1974 | Throner, Jr. | 102/393 |
| 3,875,862 | 4/1975 | Fischer et al. | 102/211 |
| 4,050,381 | 9/1977 | Heinemann | 102/211 |

FOREIGN PATENT DOCUMENTS 2136788 2/1973 Fed. Rep. of Germany .

*Primary Examiner*—Charles T. Jordan

[57] ABSTRACT

Missile head to be released in an airplane cargo drop or from a flying body. The missile head has a target-sensor having a transmitter, a receiver, an antenna and an explosive charge ignitable by a target location signal. In order not to interfere with the function of the explosive charge, it is best that the antenna be located in front of the target-sensor with respect to the flight direction, while the target-sensor is located behind the explosive charge with respect to the flight direction. The connection between the antenna and the target-sensor is provided by a wave carrier filled with explosives.

3 Claims, 3 Drawing Figures

MISSILE HEAD TO BE RELEASED IN AN AIRPLANE CARGO DROP OR FROM A FLYING BODY

The invention concerns a missile head to be released in an airplane cargo drop or from a flying body.

Missile heads of the type involved here are known from DE-OS No. 21 36 788. They are released in an airplane cargo drop or from a flying body over the target region and proceed to sink to the ground slowed by an aerodynamic brake, i.e. a parachute, whereby they autonomously sense a target, attacking it after coming within target range. To achieve that purpose, they are equipped with an explosive charge which is ignitable by a target location signal. This target location signal is supplied by a transceiver located in the missile head, which transmits a high frequency signal lying in the microwave range over an antenna, and then receives the signal again after it is reflected by the target. In order to interfere with the function of the explosive charge as little as possible, it is already known from the aforementioned prior art that the target-sensor containing the transceiver is located behind the explosive charge in relation to the flight direction, and only the antenna of the target-sensor is located in front of the explosive charge in relation to the flight direction. No explanation or description of how the antenna and the target-sensor are connected is given in the aforementioned DE-OS No. 21 36 788.

The invention has among its objects the development of a missile head of the aforedescribed type which interferes with the explosive charge as little as possible.

This goal is achieved by the missile head in accordance with the invention which comprises a target-sensor having a receiver, and if necessary, a transmitter and an antenna, and also comprising an explosive charge ignitable by a target location signal; the missile head being so arranged such that the target-sensor is behind the explosive charge with respect to the flight direction, and the antenna of the target-sensor is in front of the explosive charge with respect to the flight direction, and a wave carrier filled with explosives which connects the antenna to the target-sensor.

The wave carrier, which is filled with explosives, may be a metal pipe.

Alternatively, the wave carrier may be made of a cylinder of explosives or a column of explosives, said column or cylinder being coated with a metal layer around its outer surface.

The invention will next be described with regard to the drawings. These show:

Figure 1:
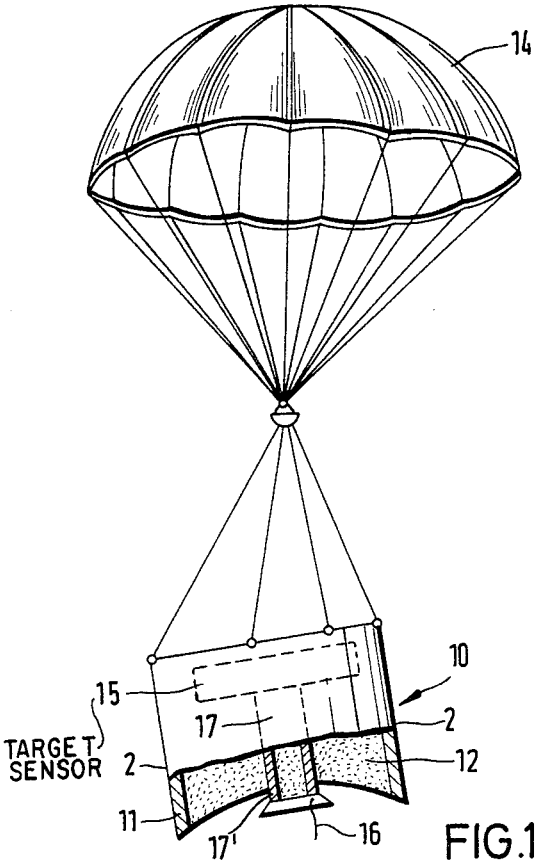
FIG. 1 is a schematic representation, partially in cross-section, of a warhead sinking with a parachute.
Figure 2:
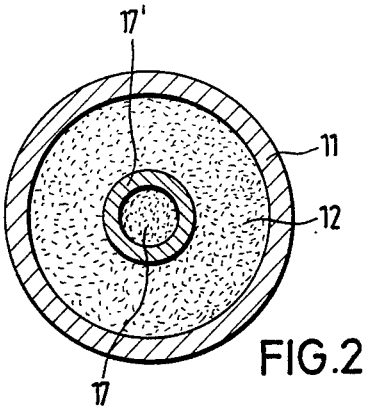
FIG. 2 is a cross-section of FIG. 1 taken along line 2—2.

FIG. 1 shows, in schematic representation, a warhead 10, which sinks over a target area slowed by an aerodynamic brake, preferably a parachute 14, after it has been transported over this target area by an airplane or a flying body. The warhead 10 contains an explosive charge 12 in a casing 11. This explosive charge can be either of the so-called projectile-shaped form or in a hollow form. The warhead 10 is in the proper position to autonomously attack a target after being released. To that effect, there is disposed in the warhead a target-sensor 15, which, in a first embodiment surrounds a microwave transmitter and a receiver. The high frequency energy produced by the transmitter is emitted by an antenna 16; the radiation reflected by a target is received by the same antenna 16 and is delivered to the receiver in the target-sensor 15 for analysis.

In a further embodiment of the invention, the target-sensor operates purely passively as a radiometer, which receives, through the antenna 16, radiation emanating from a target.

In order not to diminish the effectiveness of the explosive charge 12, it is best that the antenna 16 of the target-sensor 15 be located in front of the explosive charge 12 with respect to flight direction, while the target-sensor 15 itself is placed behind the explosive charge 12 with respect to the flight direction. If, as is known to happen in the microwave range, antenna 16 and target-sensor were connected solely by an ordinary hollow carrier or wave carrier, there could be a decline in the effectiveness of the explosive charge 12, since the effective cross-section of the explosive charge 12 is reduced. In order to prevent this disadvantageous effect, the connection between the antenna 16 and the target-sensor 15 of the warhead 10 in the present invention is made via a wave carrier 17,17' filled with explosives. A suitable wave carrier 17,17' consists of a metal pipe 17' which is filled with explosives 17. The dimensions of the metal pipe 17' should be chosen such that the microwave energy can be passed between the antenna 16 and the target-sensor 15.

Figure 3:
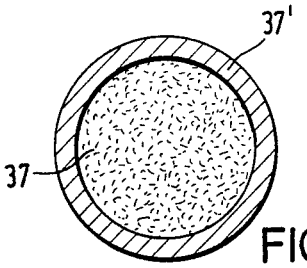
FIG. 3 is an enlarged, detailed representation similar to FIG. 2 showing a further embodiment of the invention.

In an especially advantageous embodiment of the invention shown in FIG. 3, the wave carrier comprises a cylinder 37 of explosives which is coated with a metal layer 37'. This metal layer 37' can consist of, for example, aluminum or copper. While this wave carrier is, on the one hand, well suited for the transfer of high frequency energy between the target-sensor 15 and the antenna 16, on the other hand the relatively small quantity of metal in the thin metal layer 37' does not interfere with the function of the explosive charge 12. The metal-lined explosive cylinder 37,37' is placed in a bore located centrally in the explosive charge 12.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A missile head to be released in an airplane cargo drop or from a flying body, comprising a target-sensor having a receiver, a transmitter, an antenna, and an explosive charge ignitable by a target location signal, the missile head being so arranged such that the target-sensor is behind the explosive charge with respect to the flight direction, the antenna of the target-sensor being in front of the explosive charge with respect to the flight direction, and a wave carrier filled with explosives which connects the antenna to the target-sensor.

2. A missile head according to claim 1, whereby the wave carrier is made of a metal pipe filled with explosives.

3. A missile head according to claim 1, whereby the wave carrier is made of a cylinder of explosives, said cylinder being coated with a metal layer around its outer surface.

* * * * *